US007068128B1

(12) United States Patent
Macdonald et al.

(10) Patent No.: US 7,068,128 B1
(45) Date of Patent: Jun. 27, 2006

(54) COMPACT COMBLINE RESONATOR AND FILTER

(75) Inventors: Perry Macdonald, Newbury Park, CA (US); Peter Petre, Agoura, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/896,304

(22) Filed: Jul. 21, 2004

(51) Int. Cl.
*H01P 1/205* (2006.01)

(52) U.S. Cl. ..... 333/206; 333/207; 333/222; 333/203

(58) Field of Classification Search ..... 333/202, 333/203, 206, 207, 222, 223, 235
See application file for complete search history.

(56) References Cited

U.S. PATENT DOCUMENTS

| | | | | |
|---|---|---|---|---|
| 3,496,498 | A * | 2/1970 | Takeshi et al. | 333/210 |
| 4,224,587 | A * | 9/1980 | Makimoto et al. | 333/205 |
| 4,890,078 | A * | 12/1989 | Radcliffe | 333/134 |
| 6,215,376 | B1 * | 4/2001 | Hagstrom et al. | 333/203 |
| 6,396,366 | B1 * | 5/2002 | Raty et al. | 333/222 |
| 6,466,110 | B1 * | 10/2002 | Wulff et al. | 333/222 |
| 2004/0051602 | A1 * | 3/2004 | Pance et al. | 333/202 |

FOREIGN PATENT DOCUMENTS

JP 57136804 A * 8/1982

OTHER PUBLICATIONS

Macchiarella et al., "Combline Filters Using Conical Resonators", 33rd European Microwave Conference, Oct. 7-9, 2003, pp. 167-170.*

CST advertisement in *Microwave Journal*, Nov. 2003, Horizon House Publications Inc., Norwood, Massachusetts, USA.

Guohua Shen and Djuradj Budimir, "Combline Filters Using Periodically Loaded Resonators," *Microwave and Optical Technology Letters*, Feb. 5, 2004, pp. 189-191, vol. 40, No. 3, Wiley Periodicals, Inc., Hoboken, New Jersey, USA.

* cited by examiner

*Primary Examiner*—Seungsook Ham
(74) *Attorney, Agent, or Firm*—Christie, Parker & Hale, LLP

(57) ABSTRACT

A compact combline resonator and filter. The annular radius of inductive posts are modulated along the length of the inductive post to establish a desired inductive value for a series inductive capacitive resonator. The filter has a waveguide channel with an input port and an output port. One or more of the inductive posts are located in the waveguide channel, the one or more inductive posts providing filter poles and coupling the input port to the output port, each inductive post being electrically connected at one post end to a wall of the waveguide channel and providing a capacitance gap between an other post end and an opposing wall of the waveguide channel to provide a series inductive capacitive resonator.

16 Claims, 15 Drawing Sheets

COMPACT COMBLINE RESONATOR AND FILTER

STATEMENT REGARDING FEDERALLY SPONSORED RESEARCH OR DEVELOPMENT

This invention was made with U.S. Government support under Contract No. N00014-03-C-0318 awarded by the Office of Naval Research. The U.S. Government has certain rights to this invention.

BACKGROUND OF THE INVENTION

The present invention relates to the field of electrical filters, and in particular, a resonator that can be used in combline filters operating at microwave frequencies.

In modern electrical and electronics systems environments, particularly in advanced multi-signal radio frequency (RF) system architectures, system components are subject to the demands of varying frequency ranges, to smaller and smaller physical size and configuration restraints, and to lower weight and lower cost requirements.

Well-known to those skilled in the art is the combline filter which employs one or more resonators. The combline filter is an important component of such advanced multi-function RF system architectures and such modern systems' environments. Of particular concern is the ability to have smaller filters for a given frequency. Smaller filters are attractive for many system requirements that include smaller height, lower cost, lower weight.

Typically, one or more cylindrical posts are used in a rectangular housing to form a combline filter. The length of the post and the distance from the opposing wall are adjusted until resonance at the desired frequency is achieved.

Various prior art approaches have been employed to lower the resonating frequencies and to minimize size. One approach to make the typical resonator resonate at lower frequencies is to decrease the gap between the post and the opposing wall. However, as the gap becomes smaller, the sensitivity of the resonant frequency is significantly and nonlinearly increased. An approach for reducing the size usually includes the introduction of other materials to reduce the electrical wavelength within the filter. However, these added materials usually increase the propagation losses for the entire filter.

Therefore, a need exists for an efficient combline resonator and filter capable of operating at reduced frequencies with minimal propagation loss, while maintaining a small size. The present invention provides a solution to meet such needs.

SUMMARY OF THE INVENTION

In accordance with the present invention a method of lowering a resonant frequency of an inductive post used as a series inductive capacitive resonator in a combline microwave filter is provided. The annular radius of the inductive post is varied along the length of the inductive post to establish a desired inductive value for the series inductive capacitive resonator.

In an exemplary embodiment the modulating of the annular radius of the inductive post is varied along the length of the inductive post.

In an exemplary embodiment a surface radius of an end the inductive post which forms a capacitive gap with a wall of a waveguide channel of the combline microwave filter is varied to establish a desired capacitance value for the series inductive capacitive resonator.

A method of forming a pair of coupled inductive posts used as a pair of series inductive capacitive resonators in a combline microwave filter is also provided. The annular radius of a first inductive post is modulated along the length of the first inductive post to establish a desired inductive value for a first series inductive capacitive resonator. The annular radius of a second inductive post is modulated along the length of the second inductive post to establish a desired inductive value for a second series inductive capacitive resonator. The annular radius of the first inductive post along the length of the first inductive post and the annular radius of the second inductive post along the length of the second inductive post are respectively established such that when the first inductive post and the second inductive post are parallel adjacent each other one or more respective radial ends interleave without making contact between the first inductive post and the second inductive post.

In accordance with another exemplary embodiment of the present invention a combline microwave filter is provided. The filter has a waveguide channel with an input port and an output port. One or more inductive posts are located in the waveguide channel, the one or more inductive posts providing filter poles and coupling the input port to the output port, each inductive post being electrically connected at one post end to a wall of the waveguide channel and providing a capacitance gap between an other post end and an opposing wall of the waveguide channel to provide a series inductive capacitive resonator. The one or more inductive posts have a annular radius which modulates along the length of the inductive post to establish a desired inductive value.

In a further exemplary embodiment the combline microwave has one or more inductive posts forming poles of a chebyshev filter.

In yet another exemplary embodiment the combline microwave filter has one or more inductive posts forming poles of an elliptical filter.

In still another exemplary embodiment the combline microwave filter has at least one pair of adjacent coupled inductive posts wherein each are formed such that the annular radius of a first inductive post is modulated along the length of the first inductive post to establish a desired inductive value for a first series inductive capacitive resonator; and the annular radius of a second inductive post is modulated along the length of the second inductive post to establish a desired inductive value for a second series inductive capacitive resonator. The annular radius of the first inductive post along the length of the first inductive post and the annular radius of the second inductive post along the length of the second inductive post are respectively established such that when the first inductive post and the second inductive post are parallel adjacent to each other one or more respective radial ends interleave without making contact between the first inductive post and the second inductive post.

In a further exemplary embodiment the combline microwave filter has a first inductive post coupled to a second inductive post through a coaxial feedthrough.

In yet another exemplary embodiment a method of lowering a resonant frequency of an inductive post used as a series inductive capacitive resonator in a combline microwave filter is provided wherein the sectional area of the inductive post is modulated along the length of the inductive post to establish a desired inductive value for the series inductive capacitive resonator. The modulating of the sectional area of the inductive post can be varied along the length of the inductive post. The surface of an end the inductive post which forms a capacitive gap with a wall of a waveguide channel of the combline microwave filter can be to establish a desired capacitance value for the series inductive capacitive resonator. The sectional area can be selected as being square, rectangular, diamond, or the like, or even non-uniform.

DETAILED DESCRIPTION

In conjunction with phased arrays, wherein radiating elements and their respective up-converters and transmitter in close proximity thereto are kept a certain minimum distance apart, filters used therein need to be a certain predetermined housing size. The internal resonator height can be changed to meet frequency requirements, but can face the problem of physical size restriction. While the width can also be changed, changing the width would be at the expense of introducing insertion loss.

Figure 1:
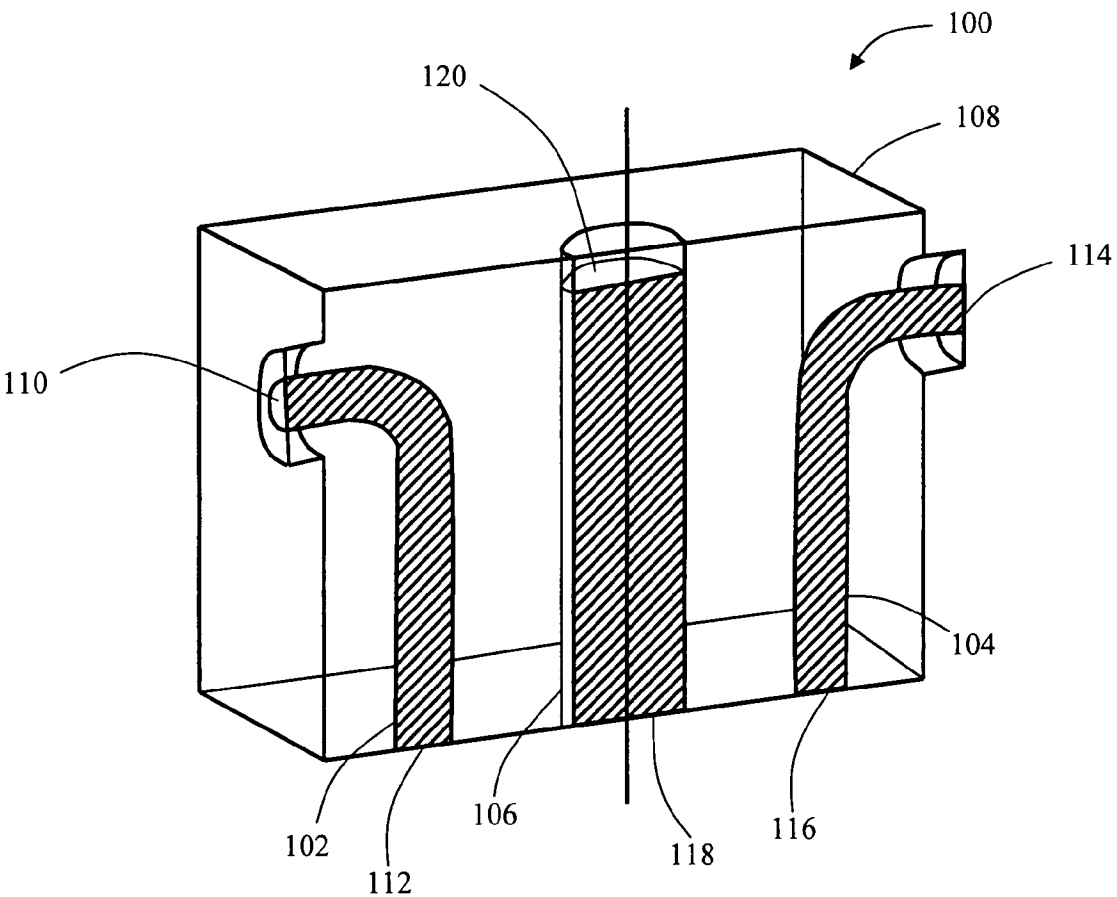
FIG. 1 (PRIOR ART)
FIG. 1 shows a half cutaway view of typical single pole combline filter.

Referring to FIG. 1, there is shown in a half cutaway view of typical single pole combline filter 100. Combline filter 100 has input probe 102, output probe 104 and a single pole series inductance—capacitance resonant post 106 situated in metal housing 108. Input probe 102 has coaxial input 110 and is electrically connected to metal housing 108 at surface 112. Output probe 104 has coaxial output 114 and is electrically connected to metal housing 108 at surface 116. One end of resonant post 106 is electrically connected to metal housing 108 at surface 118 and its other end is separated from housing 108 by desired capacitance gap 120.

Figure 2A:
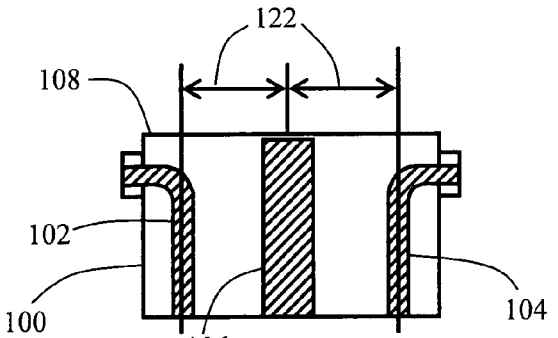
FIG. 2a (PRIOR ART)
FIGS. 2*a*–2*d* show section views of a single pole combline filter and its Qe vs. probe distance and insertion loss/isolation vs. frequency characteristics.
Figure 2B:
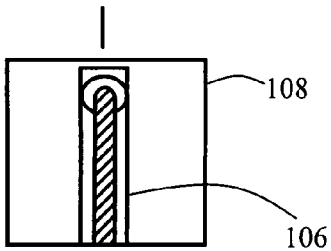
FIG. 2b (PRIOR ART)
Figure 2C:
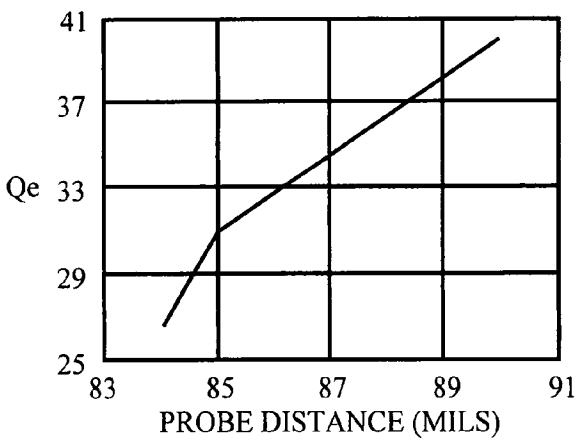
FIG. 2c (PRIOR ART)
Figure 2D:
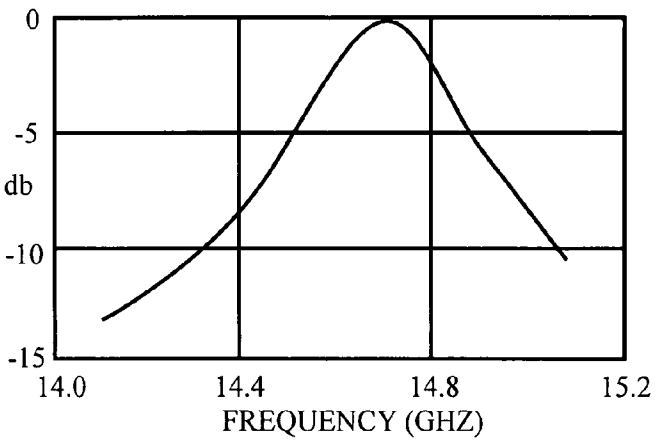
FIG. 2d (PRIOR ART)

The specific dimensional configurations of the filter shown in FIG. 1 is designed to determine the external Qe of the filter over a desired frequency band. Referring to FIGS. 2*a*–2*d*, probe distances 122 between input probe 102 and resonant post 106 and between resonant post 106 and output probe 104 is changed until a desired external Qe is obtained, as seen in FIG. 2*c*, in addition to desired filter insertion loss and isolation characteristics, as seen in FIG. 2*d*.

Figure 3B:
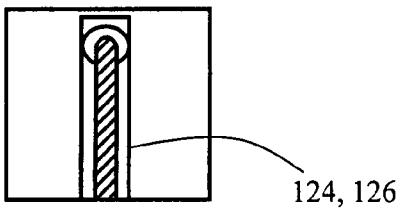
FIG. 3b (PRIOR ART)
FIGS. 3*a*–3*c* show section view of a dual pole combline filter and its loss/isolation vs. frequency characteristics.
Figure 3A:
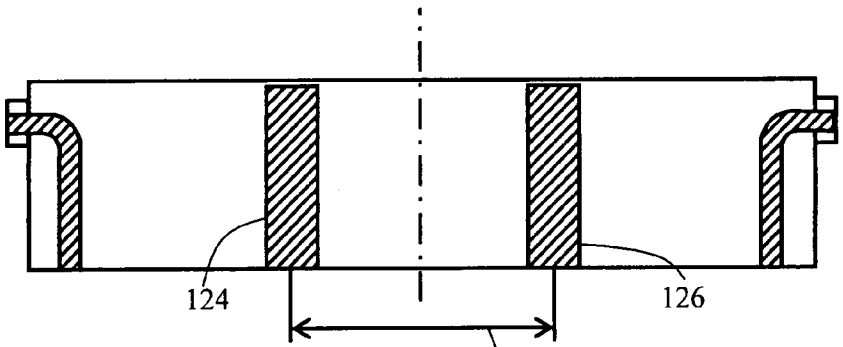
FIG. 3a (PRIOR ART)
Figure 3C:
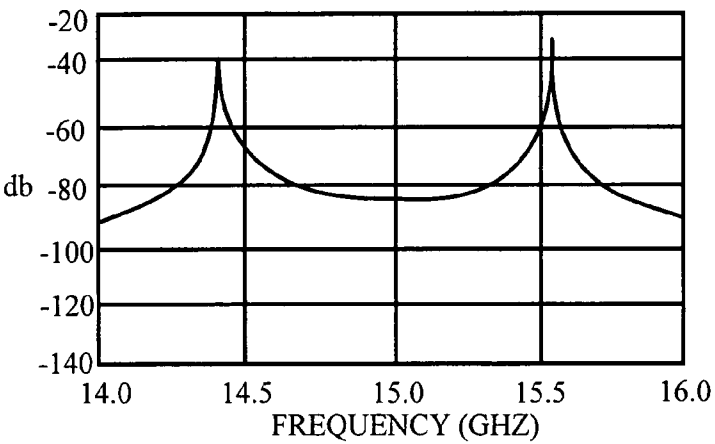
FIG. 3c (PRIOR ART)

Referring now to FIGS. 3*a*–3*c*, those skilled in the art can appreciate that multiple poles 124, 126 can be utilized, with coupling distance 128 additionally determined to satisfy a desired frequency response as shown in FIG. 3*c*.

Referring now to FIGS. 4*a*–4*d*, those skilled in the art can appreciate that diplex filters can implement the multi-resonant post concepts described above. A coaxial input provides a coupling element, which allows an input signal to be coupled to the resonator posts in respective cavities separated by a dividing rib, in effect providing two waveguide channels. One end of each post is electrically connected to one wall and the other end comes close to but does not touch the other far wall. To an incoming signal each post looks like an inductor and the gap between the post and the far wall looks like a capacitor.

Figure 4A:
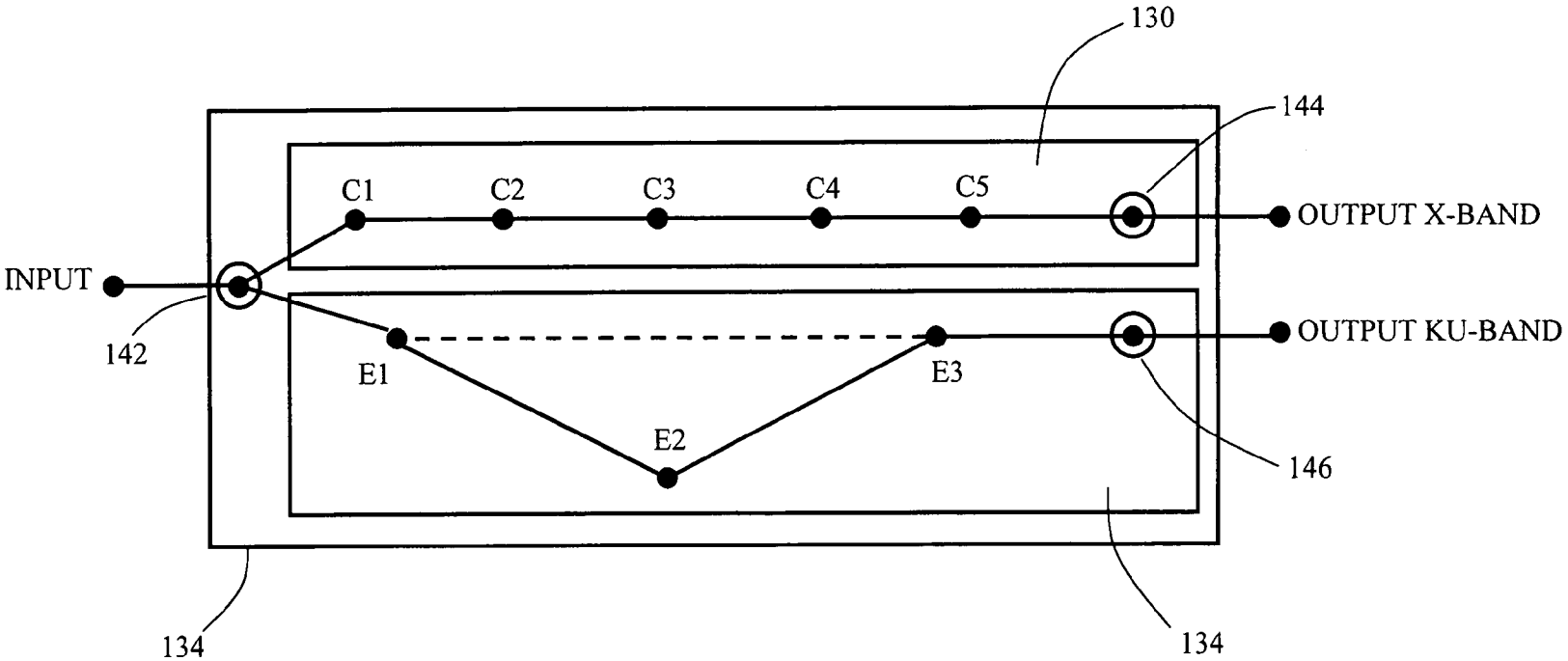
FIG. 4a (PRIOR ART)
FIGS. 4*a*–4*d* show schematic and perspective views of a dual channel combline filter and its insertion loss/isolation vs. frequency characteristics.
Figure 4B:
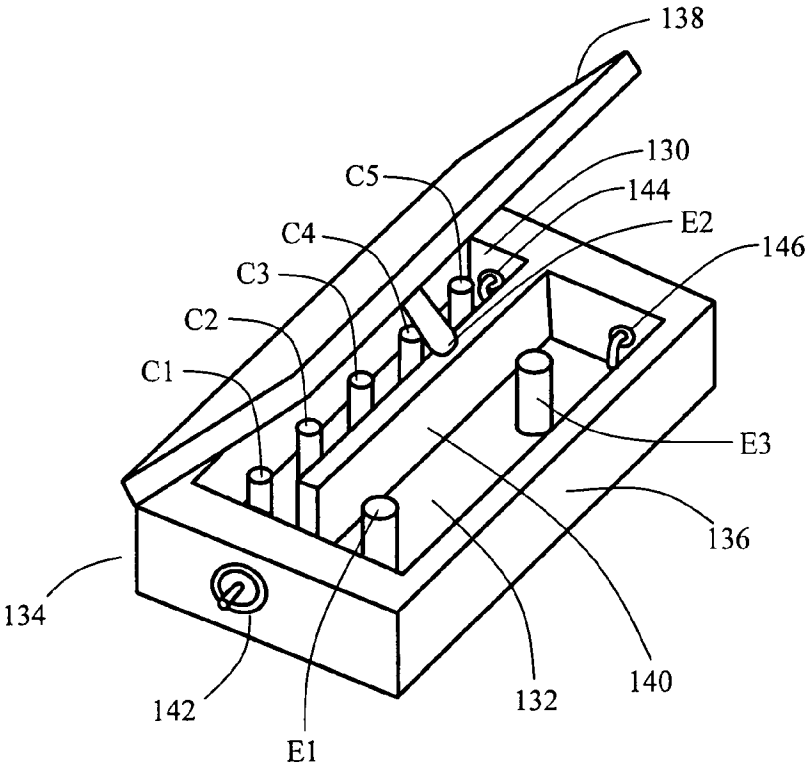
FIG. 4b (PRIOR ART)

In the schematic diagram of FIG. 4*a* and the corresponding perspective diagram of FIG. 4*b*, chebyshev filter 130 with five pole resonant posts C1–C5, and elliptical filter 132 with three pole resonant posts E1–E3 are housed in parallel in metal housing 134 which has base 136 and cover 138 (which is shown in an open position in FIG. 4*b* but is normally affixed to base 136 in operation). Base 136 has channel-separating rib 140 providing a dual channel configuration having common coaxial input probe 142 and dual output probes 144, 146.

Initially, an ideal filter with ideal components is typically simulated. Coupling coefficients between cylindrical posts C1, C2, C3, C4 and C5 for the chebyshev filter channel 130, and coupling coefficients between cylindrical posts E1, E2 and E3 for Elliptical filter channel 132 are chosen to provide desired filter responses, e.g., output 144 being operative in X-band and output 146 being operative in Ku-band. The chebyshev filter channel has its five posts in a straight line, wherein coupling occurs between input probe 142 and post C1, between post C1 and post C2, between post C2 and post C3, between post C3 and post C4, between post C4 and C5, and between post C5 and output probe 144. Elliptical filter channel 132 has its three resonant posts in a triangular pattern, wherein coupling occurs between input probe 142 and post E1, between post E1 and post E2, between post E2 and post E3, and between post E3 and output probe 146, with cross-coupling (shown by dashed lines) also being provided between post E1 and post E3. Of note, is that in elliptical filter 132, post E2 is electrically coupled to cover 138 such that a capacitance gap is formed between the unattached end of post E2 and in inner bottom surface of base 132. This alternating of the gaps in the elliptical filter allows poles of opposing polarities to be established, as is well understood by those skilled in the art, namely, the reversal of the gap electrically changing the sign of the filter coupling coefficient.

Figure 4D:
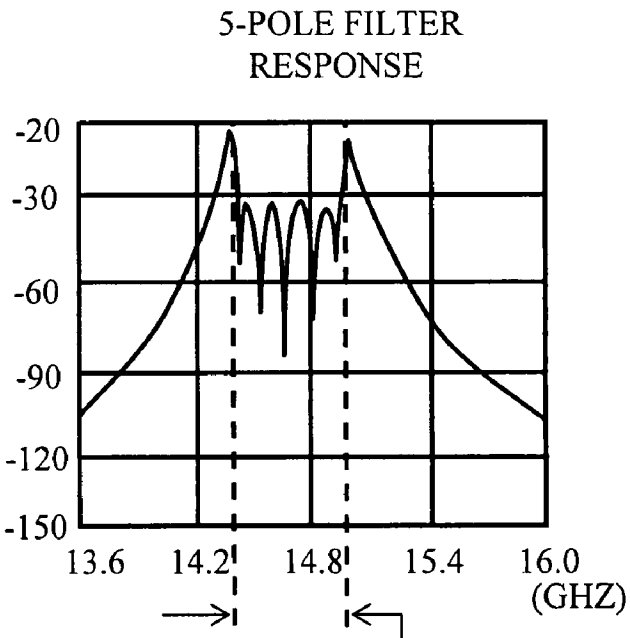
FIG. 4d (PRIOR ART)
Figure 4C:
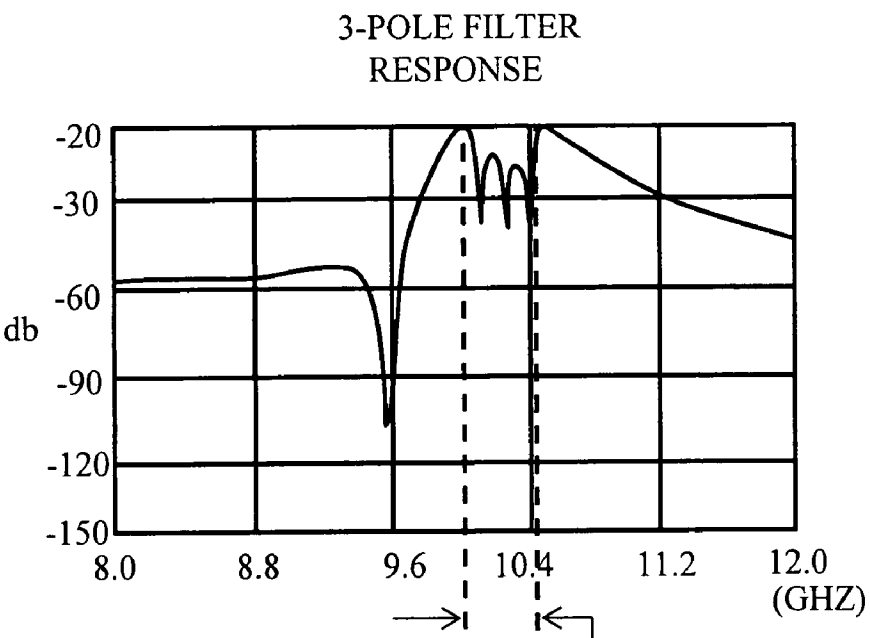
FIG. 4c (PRIOR ART)

FIGS. 4*c* and 4*d* show typical respective three pole filter and five pole filter responses having a design goal to meet certain pass band insertion loss and rejection band isolation criteria over certain frequency ranges.

Once there is a prototype filter response and coupling values established for the desired criteria, the external Qe is then determined by simulation involving distances between probes, for example, the input coupling to post distance, and the post to output coupling distance for the width and height of the cavity channel. Multiple resonators can then be factored into the design comparing the distances between the respective posts, to determine the coupling coefficients and the modes propagating. The distances are typically kept less than ¼ wavelength. The diameter of the posts are typically chosen for manufacturability, for example, a five to one aspect ratio of length to diameter, and have a fairly slow function for the external Qe, as compared to the separation between the probes. An example capacitance gap thickness would be about ⅕ of the diameter of the post. Capacitance gaps for these examples would be in the 4.5 mm ground spacing range.

In accordance with the present invention, the overall length of the resonator is allowed to remain the same to meet the desired resonance at the desired frequency range, by adjusting the external post path length to be in a more serpentine line rather than a cylindrical surface straight line. Accordingly, the overall housing package is allowed to advantageously remain the same.

Figure 5B:
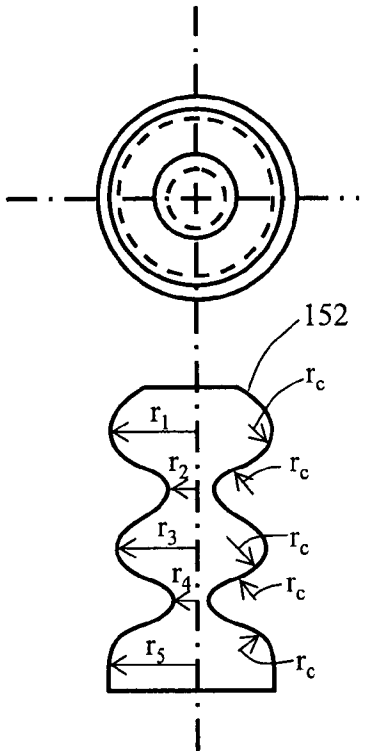
FIGS. 5*a* and 5*b* show in plan and top views a prior art cylindrical resonator and a resonator in accordance with the present invention.
Figure 5A:
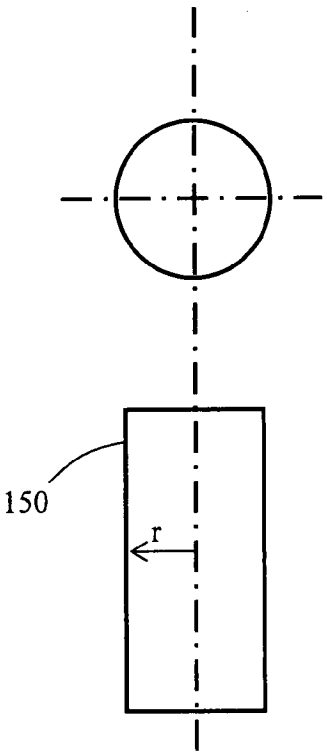
FIG. 5a (PRIOR ART)
Figure 6:
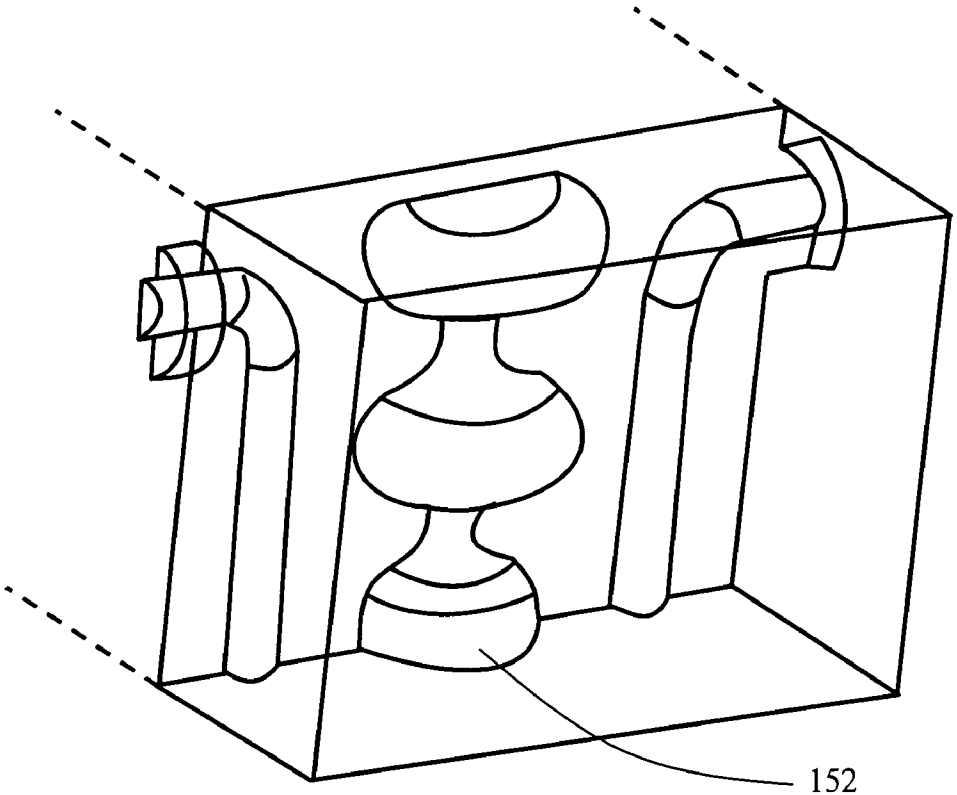
FIG. 6 shows a single pole filter implementing the resonator in accordance with the present invention.
Figure 7:
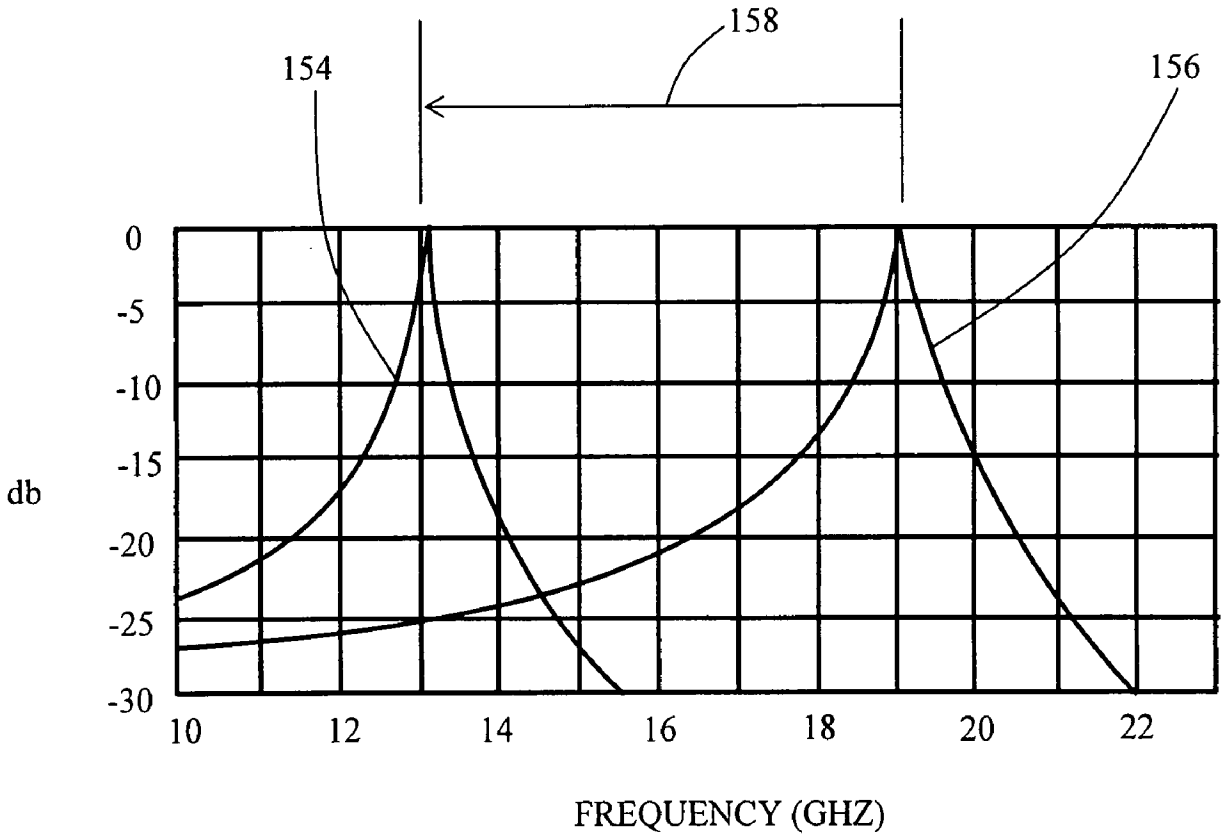
FIG. 7 shows the insertion loss/isolation vs. frequency comparison between a single pole filter using a prior art resonator and a single pole filter using the resonator in accordance with the present invention.

Referring now to FIGS. 5*a*, 5*b*, there is shown in FIG. 5*a* prior art cylindrical resonant post 150 having an annular radius r and in FIG. 5*b* serpentine resonant post 152 in accordance with the present invention. The serpentine resonator in accordance with the present invention is substitutable for the cylindrical resonant post in a combline filter and is formed by smoothly oscillating the annular radius (e.g., $r_1$–$r_5$) of the resonant post from top to bottom, e.g., in a serpentine manner. The oscillation in the annular radius will force the electric currents to travel a longer path, allowing the resonator to resonate at a lower frequency than a standard resonator of equivalent dimensions having cylindrical posts. Typical annular ring radial dimensions for the resonant post in FIG. 5*b* could be $r_1$=0.87 mm, $r_2$=0.41 mm, $r_3$=0.84 mm, $r_4$=0.36 mm and $r_5$=0.89 mm for the 10–24 Ghz frequency range. Typical radii $r_c$ for the inner and outer radii in planes coincident with the centerline of the cylindrical post would be the same, such as $r_c$=0.27 mm Referring to FIG. 6, there is shown in half cutaway view, a filter embodiment wherein serpentine resonant post 152 is substituted for cylindrical resonant post 106 in the same input/output/housing of filter 100 as depicted in FIG. 1. FIG. 7 shows frequency response curve 154 for the filter having serpentine resonant post 152 and frequency response curve 156 for the filter having cylindrical resonant post 150. As can be seen in FIG. 7, a frequency range drop 158 is provided when the serpentine resonant post replaces the cylindrical resonant post in the same housing. The filter in accordance with the present invention resonates at ~13 GHz while the typical resonator resonates at ~19 GHz. With the same cavity size and capacitance gap being maintained As described above, a normal resonator requires a certain capacitance between the top of the resonator and the opposing wall at resonance. The resonator in accordance with the present invention can accommodate having a larger top surface, thereby increasing the capacitance. This increased capacitance and increased path length will allow the resonator to resonate at lower frequency. By adjusting the capacitance and inductance, the resulting resonant frequency can changed. By making the inductance larger and making the capacitance smaller the resonant frequency will change. By allowing the length of the resonant post to change, the need to maintain tighter and tighter manufacturing tolerances to provide small capacitance gaps is avoided along with resonant frequency change sensitivity.

When the serpentine resonator post replaces the cylindrical resonator post in the same housing size, the resonator will operate at a much lower resonant frequency. Various sizes of the radii of the serpentine resonator as it progresses from top to bottom are available based upon ease of manufacture to achieve the desired top to bottom skin length, namely, the longest path length possible. The ratios of the largest to smallest diameters can vary along the length of the resonator.

The resonator in accordance with the present invention can be used in the design process in the same manner as the standard resonator. The input and output coupling to the resonator is calculated using electromagnetic simulation. Then, the coupling between the resonators is calculated for several different displacements of two or more resonators from electromagnetic simulations.

Embodiments of the resonator concepts in accordance with the present invention can include complementary interleaved resonators, allowing very close coupling between resonators while maintaining the same path length along the respective resonator posts.

Figure 8:
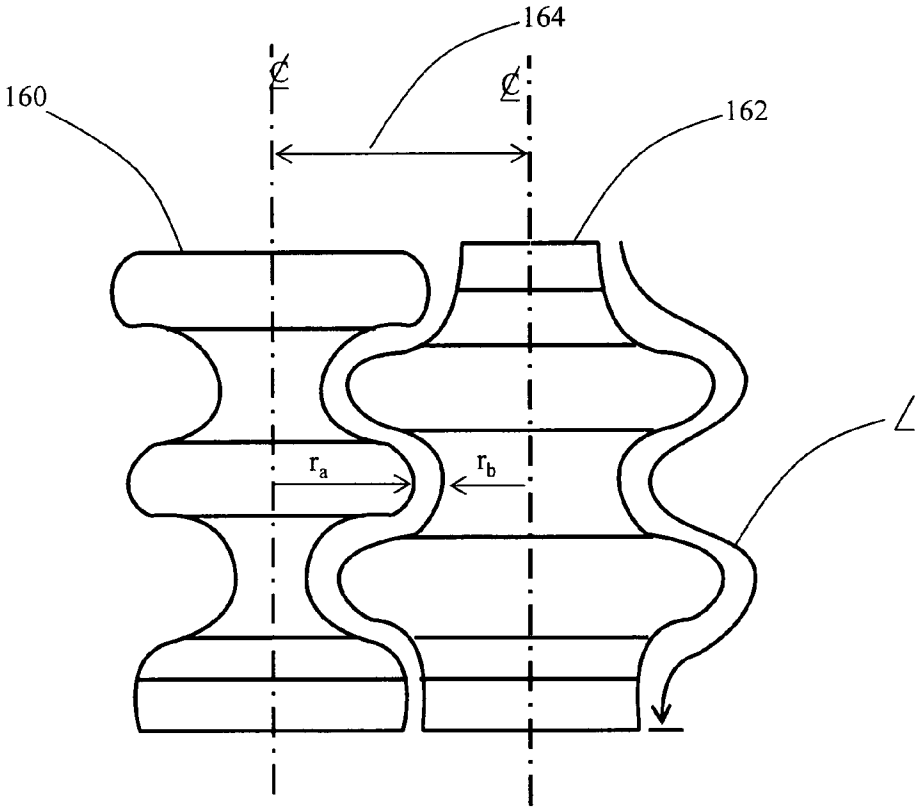
FIG. 8 shows a complementary pair of resonators in accordance with the present invention.

Referring to FIG. 8, there is shown first serpentine resonant post 160 and second serpentine post 162. As can be seen, the variation of radii of the respective complementary posts allows for a larger annular radius $r_a$ of first serpentine resonant post 160 to fit into the space vacated by a smaller annular radius $r_b$ of second serpentine resonant post 162. This allows the ability of the serpentine posts to provide closer center line spacings 164 when needed to adjust coupling coefficients between adjacent resonant posts, while still maintaining a desired resonant post path length, e.g., path length L for resonant post 162. As a representative embodiment annular radius $r_a$ would be 0.40 mm, annular radius $r_b$ would be 0.42 mm and path length L would be 4 mm.

Further, the complementary serpentine resonant posts allow the gap to wall capacitance of each of such closely coupled resonators to be varied based upon the diameter size of the surface at the gap and then the resonators can be appropriately separated to obtain the requisite coupling coefficient between the resonator posts.

Figure 9A:
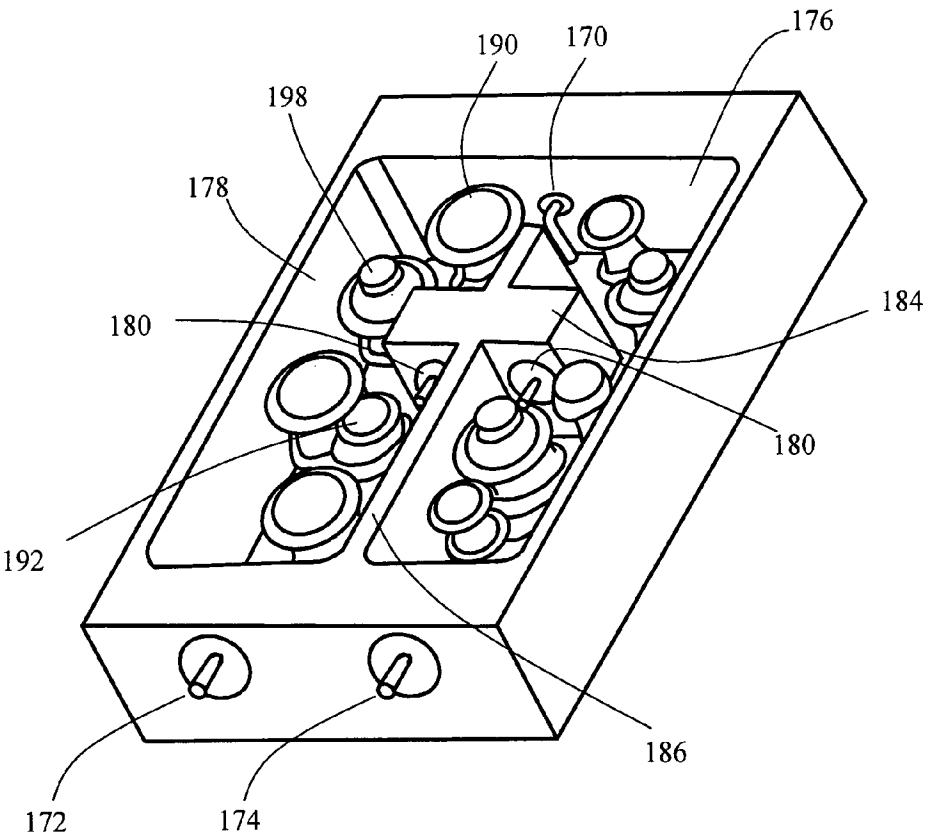
FIGS. 9*a* and 9*b* show perspective and plan views of a dual channel combline filter implementing resonators in accordance with the present invention.
Figure 9B:
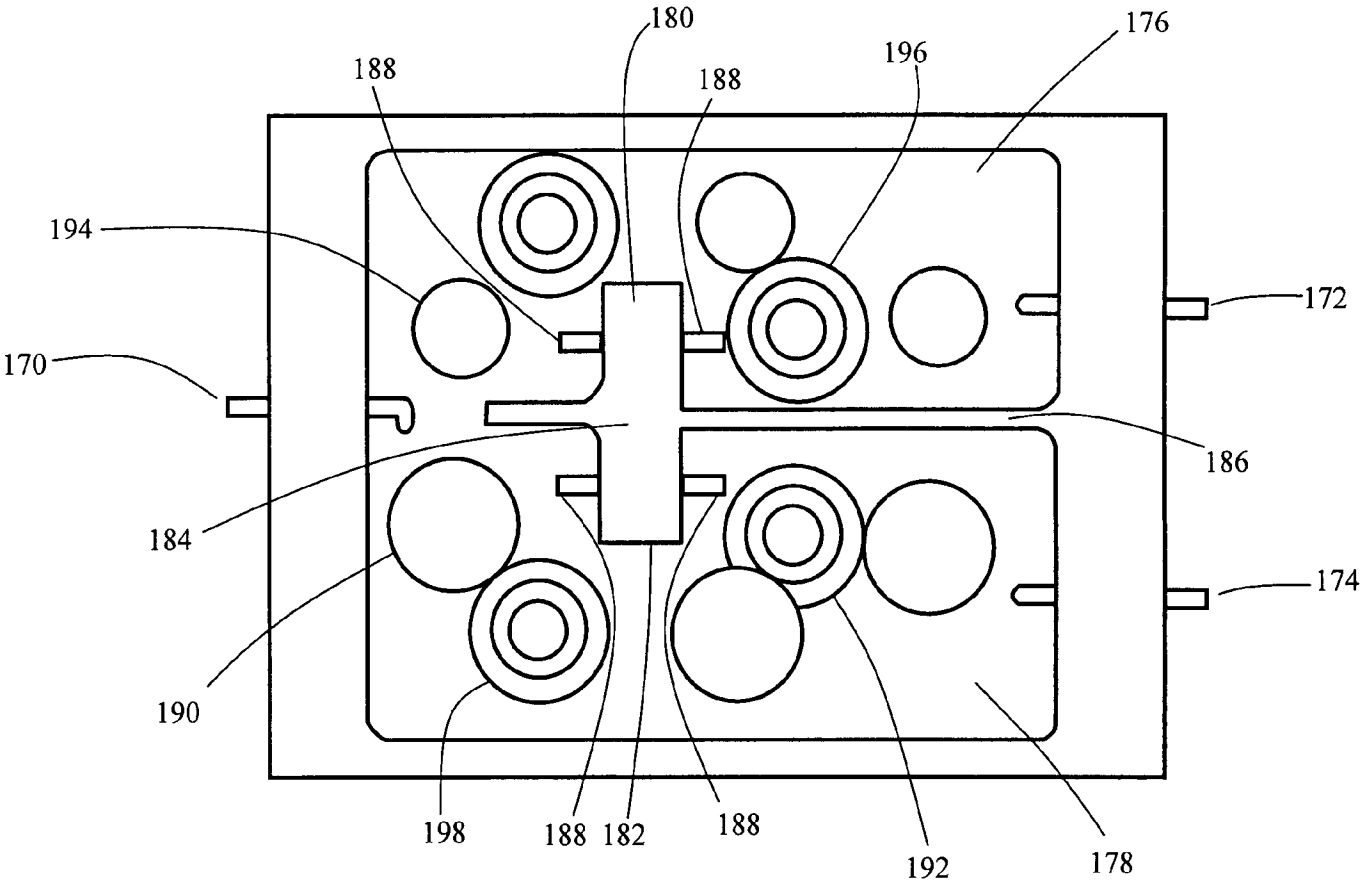

Referring now to FIGS. 9*a* and 9*b*, an embodiment of a diplexed filter is shown wherein two different five resonant pole bandpass filters are incorporated in the same housing using various serpentine resonator posts in accordance with the present invention.

As in the filter embodiment shown in FIGS. 4*a* and 4*b*, external to the package there are three coaxial ports 170, 172, 174, which can be used bi-directionally, coupling to two parallel channel cavities 176, 178. Further, there are two internal coaxial feedthroughs 180, 182 affixed within internal cross-rib 184 on channel dividing rib 186. Each feedthrough has center conductor probe 188 protruding into the cavity on each side of cross-rib 184. The center conductor probes allow higher coupling to be achieved as needed in the filter design between non-adjacent resonator posts, for example, between resonator posts 190 and 192 and between resonator posts 194 and 196. As such, any needed coupling would be achieved between post 190 and adjacent post 198 and also between post 190 and non-adjacent post 192.

The entire housing and resonators are typically metal injection molded. Depending on the metal used, the housing may then be plated. The glass-metal feedthroughs are then soldered in place. A cover (not shown) would be attached after the performance is verified.

Figure 10B:
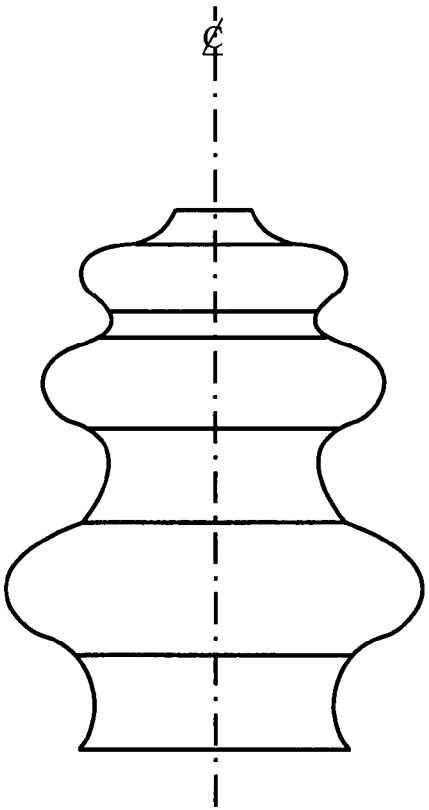
FIGS. 10*a*, 10*b* and 10*c* show plan views of alternative resonator configurations in accordance with the present invention.
Figure 10A:
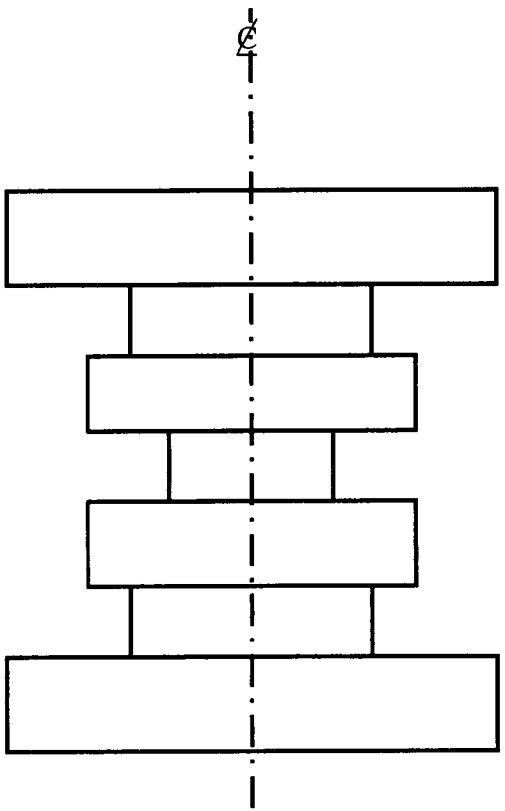
Figure 10C:
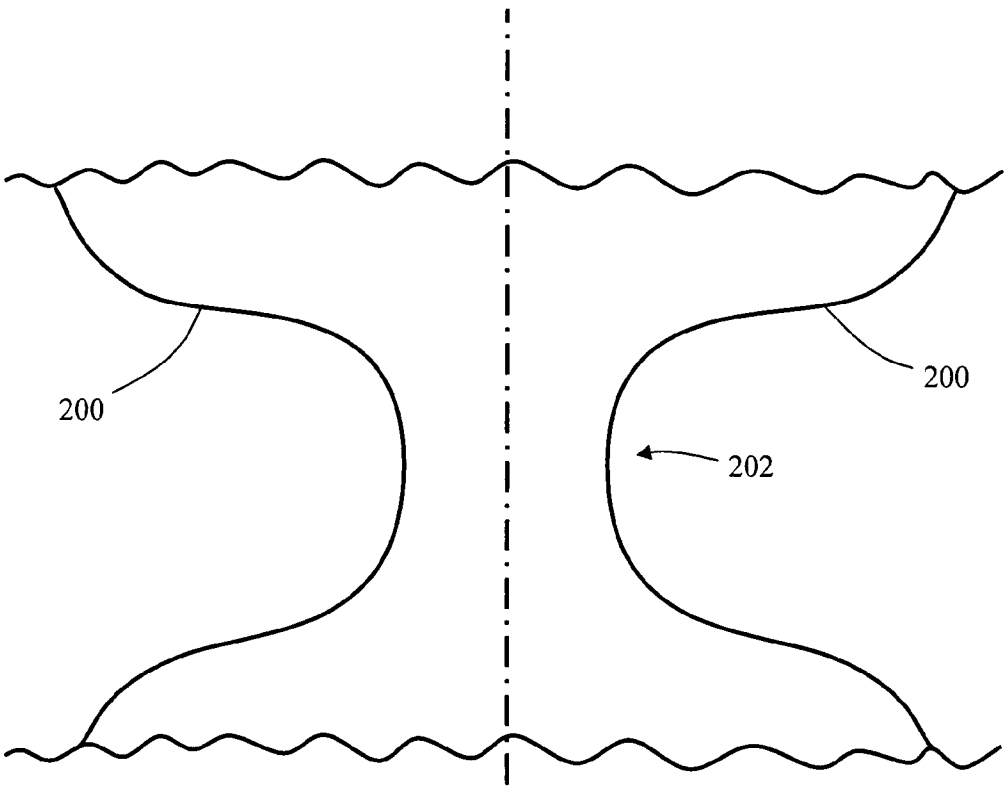

Those skilled in the art can appreciate that, while exemplary embodiments of the present invention have been described, various alternatives can be utilized to practice the invention. For example, although a smooth shape is advantageous to maintain Qe, other shapes may be used depending on the application. Referring to FIG. 10*a*, a resonant post with rectangular or square shapes without smooth edges (e.g., without radii $r_c$ as in FIG. 5*b*) may be advantageous from a cost perspective, even if the loss resulting from the use of a rectangular shape with sharp corners may be higher than that for a smooth shaped post. Referring to FIG. 10*b*, the frequency of the annular radius oscillation can vary along the length, and/or the amplitude of the annular radius can change. Each succeeding peak annular radius, or the rate of change of the annular radius, for example, can be higher or lower more toward the top or bottom, or more toward the middle, of the resonator. Referring to FIG. 10*c*, those skilled in the art can appreciate that one approach to varying the annular radius over the length of the resonator would be to utilize the selective placement of flat spots 202, such as a 0.002 mm flat spot, in a transition area between an external annular radius and inner neck radius 202.

Figure 11:
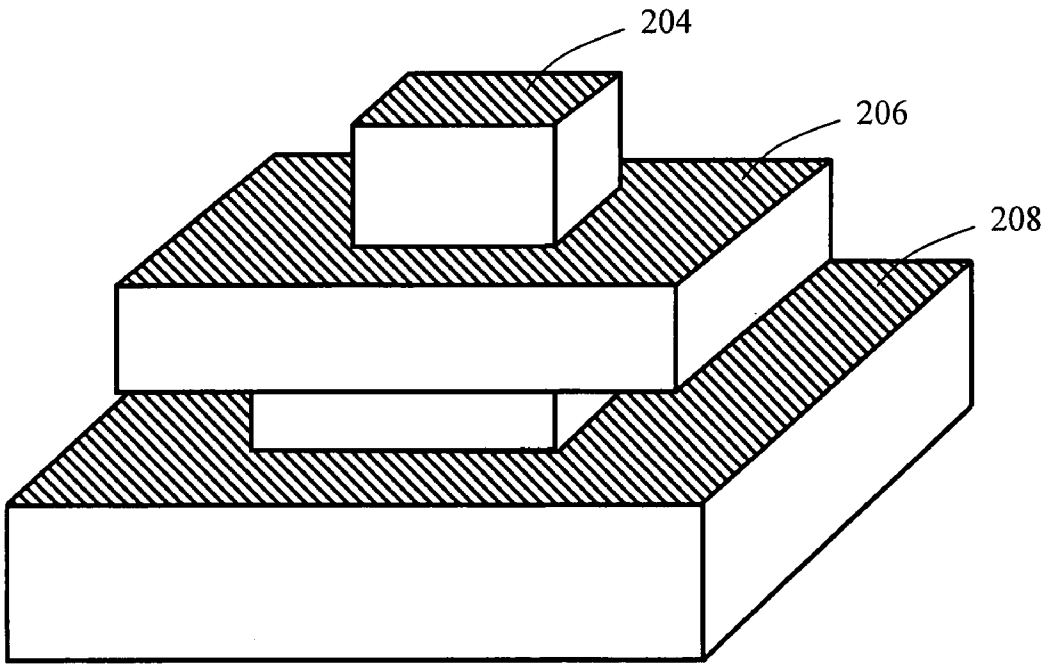
FIG. 11 shows a perspective view of an alternative embodiment resonator in accordance with the present invention.

Further, those skilled in the art can appreciate that rather than having annular radii along the length of the resonant post, discrete sectional areas, such squares, rectangles, diamonds, and the like, including even non-uniform sectional areas can be used, the square, rectangular diamond and the like sizes modulating in a similar fashion as the embodiments having annular radii. FIG. 11 shows a perspective view of a representative example resonant post embodiment with four levels of discrete sectional areas rectangles. Three of the four sectional areas 204, 206, 208 are shown cross-hatched.

Various combinations of the above-mentioned alternatives are also possible.

As described above, embodiments of the present invention are more compact than the typical prior art resonator, resulting in the ability to use smaller filters for a given frequency. The use of the serpentine resonator in accordance with the present invention allows system integrators to be able to provide for smaller filters to meet many system requirements necessitating smaller height, lower cost and lower weight.

What is claimed is:

1. A method of lowering a resonant frequency of an inductive post having an annular radius and used as a series inductive capacitive resonator in a combline microwave filter comprising:

curvedly modulating the annular radius of the inductive post along the length of the inductive post to establish a desired inductive value for the series inductive capacitive resonator.

2. The method of claim 1, further comprising varying amplitude and/or frequency of the curvedly modulating of the annular radius of the inductive post along the length of the inductive post.

3. The method of claim 1, further comprising varying a surface radius of an end the inductive post which forms a capacitive gap with a wall of a waveguide channel of the combline microwave filter to establish a desired capacitance value for the series inductive capacitive resonator.

4. A method of forming a pair of coupled inductive posts, each of the coupled inductive posts having a respective annular radius terminating at a radial end at a circumference of the inductive post, used as a pair of series inductive capacitive resonators in a combline microwave filter, comprising:

modulating the annular radius of a first inductive post along the length of the first inductive post to establish a desired inductive value for a first series inductive capacitive resonator; and modulating the annular radius of a second inductive post along the length of the second inductive post to establish a desired inductive value for a second series inductive capacitive resonator;

wherein the annular radius of the first inductive post along the length of the first inductive post and the annular radius of the second inductive post along the length of the second inductive post are respectively established such that when the first inductive post and the second inductive post are parallel adjacent to each other one or more respective radial ends of the first inductive post and the second inductive post interleave without making contact between the first inductive post and the second inductive post.

5. The method of claim 4, further comprising varying a surface radius of an end of one or more of the inductive post which form a capacitive gap with a wall of a waveguide channel of the combline microwave filter to establish a desired capacitance value for the respective series inductive capacitive resonator.

6. A combline microwave filter comprising:

a waveguide channel having an input port and an output port; and one or more inductive posts located in the waveguide channel, the one or more inductive posts providing filter poles and coupling the input port to the output port, each inductive post being electrically connected at one post end to a wall of the waveguide channel and providing a capacitance gap between an other post end and an opposing wall of the waveguide channel to provide a series inductive capacitive resonator;

wherein the one or more inductive posts each have an annular radius terminating at a radial end located at a circumference of the inductive post, the annular radius curvedly modulating along the length of the inductive post to establish a desired inductive value.

7. The combline microwave filter of claim 6, wherein the one or more inductive posts form poles of a chebyshev filter.

8. The combline microwave filter of claim 6, wherein the one or more inductive posts form poles of an elliptical filter.

9. The combline microwave filter of claim 6, wherein a pair of adjacent coupled inductive posts are each formed such that:

the annular radius of a first inductive post is curvedly modulated along the length of the first inductive post to establish a desired inductive value for a first series inductive capacitive resonator; and the annular radius of a second inductive post is curvedly modulated along the length of the second inductive post to establish a desired inductive value for a second series inductive capacitive resonator;

wherein the annular radius of the first inductive post along the length of the first inductive post and the annular radius of the second inductive post along the length of the second inductive post are respectively established such that when the first inductive post and the second inductive post are parallel adjacent each other one or more respective radial ends of the first inductive post and the second inductive post interleave without making contact between the first inductive post and the second inductive post.

10. The combline microwave filter of claim 6, wherein a surface radius of an end of one or more of the inductive posts which form a capacitive gap with a wall of a waveguide channel of the combline microwave filter is varied to establish a desired capacitance value for the respective series inductive capacitive resonator.

11. The combline microwave filter of claim 6, wherein a first inductive post in coupled to a second inductive post through a coaxial feedthrough.

12. A method of lowering a resonant frequency of an inductive post having sectional areas along the length of the inductive post and being used as a series inductive capacitive resonator in a combline microwave filter comprising:

curvedly modulating the sectional areas of the inductive post along the length of the inductive post to establish a desired inductive value for the series inductive capacitive resonator.

13. The method of claim 12, further comprising varying amplitude and/or frequency of the curvedly modulating of the sectional area of the inductive post along the length of the inductive post.

14. The method of claim 12, further comprising varying a surface of an end the inductive post which forms a capacitive gap with a wall of a waveguide channel of the combline microwave filter to establish a desired capacitance value for the series inductive capacitive resonator.

15. The method of claim 12, wherein the sectional area is selected as being square, rectangular, diamond, or non-uniform.

16. A combline microwave filter comprising:

a waveguide channel having an input port and an output port;

one or more inductive posts, each inductive post having an annular radius terminating at a radial end at the circumference of the inductive post, located in the waveguide channel, the one or more inductive posts providing filter poles and coupling the input port to the output port, each inductive post being electrically connected at one post end to a wall of the waveguide channel and providing a capacitance gap between an other post end and an opposing wall of the waveguide channel to provide a series inductive capacitive resonator;

wherein the one or more inductive posts have an annular radius which modulates along the length of the inductive post to establish a desired inductive value, wherein a pair of adjacent coupled inductive posts are each formed such that: the annular radius of a first inductive post is modulated along the length of the first inductive post to establish a desired inductive value for a first series inductive capacitive resonator and the annular radius of a second inductive post is modulated along the length of the second inductive post to establish a desired inductive value for a second series inductive capacitive resonator; and wherein the annular radius of the first inductive post along the length of the first inductive post and the annular radius of the second inductive post along the length of the second inductive post are respectively established such that when the first inductive post and the second inductive post are parallel adjacent each other one or more respective radial ends of the first inductive post and the second inductive post interleave without making contact between the first inductive post and the second inductive post.

* * * * *